US007108020B2

(12) United States Patent
Stone

(10) Patent No.: US 7,108,020 B2
(45) Date of Patent: Sep. 19, 2006

(54) WARP TRIPLET COMPOSITE FORMING FABRIC

(75) Inventor: Richard Stone, Carleton Place (CA)

(73) Assignee: AstenJohnson, Inc., Charleston, SC (US)

( * ) Notice: Subject to any disclaimer, the term of this patent is extended or adjusted under 35 U.S.C. 154(b) by 152 days.

(21) Appl. No.: 10/490,601

(22) PCT Filed: Jul. 22, 2003

(86) PCT No.: PCT/CA03/01095

§ 371 (c)(1),
(2), (4) Date: Mar. 25, 2004

(87) PCT Pub. No.: WO2004/013410

PCT Pub. Date: Feb. 12, 2004

(65) Prior Publication Data

US 2004/0238063 A1 Dec. 2, 2004

(51) Int. Cl.
*D03D 11/00* (2006.01)

(52) U.S. Cl. ..... 139/383 A; 139/383 R; 139/408; 139/410; 442/203; 442/205; 162/903; 162/900; 162/348

(58) Field of Classification Search ..... 139/383 R, 139/383 A, 408, 410; 442/203, 205, 207; 162/358.2, 900, 903
See application file for complete search history.

(56) References Cited

U.S. PATENT DOCUMENTS

| | | | | |
|---|---|---|---|---|
| 5,152,326 A | | 10/1992 | Vohringer et al. | |
| 5,482,567 A | * | 1/1996 | Barreto | 139/383 A |
| 5,641,001 A | * | 6/1997 | Wilson | 139/383 A |
| 6,123,116 A | * | 9/2000 | Ward et al. | 139/383 A |
| 6,202,705 B1 | | 3/2001 | Johnson et al. | |
| 6,240,973 B1 | | 6/2001 | Stone et al. | |
| 6,334,467 B1 | | 1/2002 | Barrett et al. | |
| 6,533,901 B1 | * | 3/2003 | Taipale | 162/348 |
| 6,581,645 B1 | * | 6/2003 | Johnson et al. | 139/383 A |
| 6,810,917 B1 | * | 11/2004 | Stone | 139/383 A |
| 6,905,574 B1 | * | 6/2005 | Festor | 162/348 |

FOREIGN PATENT DOCUMENTS

| | | |
|---|---|---|
| DE | 202 02 028 | 7/2002 |
| GB | 2351505 | 1/2001 |
| WO | WO 02 00996 A | 1/2002 |

* cited by examiner

*Primary Examiner*—John J. Calvert
*Assistant Examiner*—Robert Muromoto
(74) *Attorney, Agent, or Firm*—Shapiro Cohen

(57) ABSTRACT

A forming fabric having a paper side layer and a machine side layer comprises a first set of paper side layer wefts, a second set of machine side layer wefts and a single set of warp yarn triplets. In the fabric weave pattern, each member of each triplet set of warp yarns interweaves with the paper side weft yarns to occupy in sequence segments of an unbroken warp path in the paper side surface, and each triplet in each set of warp yarns interlaces alone with at least one single machine side layer weft yarn. Each segment in the unbroken warp path is separated by at least one paper side layer weft yarn. The machine side layer interlacing points are regularly spaced. After heat setting, the fabrics typically have an air permeability typically from about 7,500 to about 10,500 $m^3/m^2/hr$. Paper products made using these fabrics have enhanced printability.

26 Claims, 2 Drawing Sheets

WARP TRIPLET COMPOSITE FORMING FABRIC

FIELD OF THE INVENTION

The present invention relates to woven forming fabrics for use in papermaking machines. The forming fabrics of this invention consist essentially of at least two layers or sets of weft yarns, one in the paper side layer of the fabric and the other in the machine side layer of the fabric, which are held together by one set of warps, which are warp yarns woven in sets of three or triplets. Thus although visually the fabrics of this invention contain at least two layers, these are not separate, interconnected woven structures, and cannot be separated into two distinct self-sustaining woven structures.

BACKGROUND OF THE INVENTION

The known composite forming fabrics comprise two essentially separate woven structures, each of which includes its own sets of warps and wefts, and each of which is woven to a pattern selected to optimise the properties of each of the layers. The paper side layer should provide, amongst other things, a minimum of fabric wire mark to, and adequate drainage of liquid from, the incipient paper web. The machine side layer should be tough and durable, provide a measure of dimensional stability to the forming fabric so as to minimize fabric stretching and narrowing, and be sufficiently stiff to minimize curling at the fabric edges. Numerous fabrics of this type have been described, and are in industrial use.

The two layers of the known composite forming fabrics are interconnected by means of either additional binder yarns, or intrinsic binder yarns. Additional binder yarns serve mainly to bind the two layers together; intrinsic binder yarns both contribute to the structure of the paper side layer and also serve to bind together the paper and machine side layers of the composite forming fabric. The paths of the binder yarns are arranged so that the selected yarns pass through both layers of the fabric, thereby interconnecting them into a single composite fabric.

In these known composite fabrics, additional weft binder yarns were generally preferred over intrinsic weft binder yarns, as they were believed to cause fewer discontinuities in the paper side surface of the composite fabric. Recently, both single and paired intrinsic warp or weft binder yarn arrangements have been proposed. However, intrinsic weft binder yarns have been found to cause variations in the cross-machine direction mesh uniformity. Composite fabrics in which intrinsic weft binder yarns are incorporated have been found to be susceptible to lateral contraction under the tensile load placed upon them in a papermaking machine. These intrinsic weft binder yarns have also been found to be susceptible to internal and external abrasion, leading to catastrophic delamination of the composite fabric. Further, due to the necessity of having to weave into the fabric structure additional weft yarns to form the paper side layer, and to bind the paper side layer and machine side layer together, these fabrics are expensive to produce.

More recently it has been proposed to use intrinsic warp binder yarns in pairs or triplets, so as to overcome at least some of these disadvantages. Fabrics of these two types are described by Vöhringer in U.S. Pat. No. 5,152,326 (pairs); by Stone et al. in U.S. Pat. No. 6,240,973 (triplets); and by Johnson et al. in U.S. Pat. No. 6,202,705 (triplets).

The use of pairs offers the advantages that the two warp binder yarns can be incorporated in sequence in successive segments of an unbroken warp path in the paper side surface, and that there is more flexibility of choice for the locations at which each member of the pair interlaces with the machine side layer wefts. It is thus possible to optimise the paper side surface to some extent, for example to reduce wire marking of the incipient paper web, and to improve the machine side layer wear resistance of the fabric, essentially by increasing the amount of material available to be abraded away before catastrophic failure, usually by delamination, occurs. In these fabrics using pairs of warp binder yarns, the paper side layer and machine side layer each have separate weft yarn systems, one of which completes the paper side layer weave, and the other of which completes the machine side layer weave.

In the following discussion of this invention, it is to be understood that in a notation such as "2×2" the first number indicates the number of sheds required to weave the pattern, and the second number indicates the number of wefts in the pattern repeat. Thus a 2×2 pattern requires two sheds, and there are two wefts in the pattern repeat.

As disclosed by Stone et al. and by Johnson et al. the use of warp triplets offers the advantage that the fabric structure can be simplified, in that the fabric can be woven with only three sets of yarns: a paper side layer set of wefts, a machine side layer set of wefts and a single set of warps which contributes to the structure of both layers. It is possible to weave a fabric having acceptable paper making properties by utilizing triplets of warp yarns so that each member of the triplets interweaves separately in sequence with the paper side layer wefts, and so that the members of the triplets interlace in pairs with the machine side layer wefts. The pairs of warp yarns when interlaced with the machine side layer weft yarns cause these yarns to bow outwards somewhat, towards the machine side surface of the fabric. This provides a wear plane which increases fabric wear potential, which increases fabric life.

The use of triplets woven in pairs with the machine side layer wefts provides a forming fabric having reduced susceptibility to cross-machine direction variations in the paper side layer mesh uniformity, less susceptibility to dimpling of the paper side surface, and better resistance to lateral contraction than comparable fabrics of the prior art. It is possible to weave some of these warp triplet fabrics from a single warp beam, because all of the warp yarns follow essentially similar paths, which have equal path lengths within the weave structure.

However it has been found that composite forming fabrics woven using triplet sets of warp yarns are still susceptible to dimpling of the paper making surface of the paper side layer. It appears that, as the warp yarns pass from one surface of the fabric to the other, eg from the surface of paper side layer to the surface of the machine side layer, they may introduce some non-uniformity into the otherwise regular spacing of the paper side layer weft yarns. This creates variations in both the shape and frame lengths of the drainage openings in the paper side layer of the forming fabric, which results in variation of the drainage properties of the fabric. These variations can introduce an unacceptable level of marking (so-called "wire mark") into the paper product being made.

It has now been found that this level of variation can be at least mitigated by interlacing each member of a warp triplet set on its own with a machine side layer weft yarn. When this step is taken, it is then possible for each member of each of the triplet sets to follow the same path within the weave pattern, thus providing more uniform location of the interlacing points. This has the result that the paper side layer surface characteristics are improved which in its turn provides more uniform formation in the paper product.

Additionally, we have found that by careful choice of the warp yarn material used in the fabrics of this invention, it is possible to weave a fabric having a high paper side surface open area with sufficient drainage area to rapidly drain the embryonic sheet into the central plane of the fabric structure, without sacrificing critical mechanical properties of the fabric, in particular its elastic modulus. In the central plane and machine side layer of the fabric, where yarn density is higher, fluid drainage appears to be retarded slightly, thus providing opportunity for pressure pulses caused by the supporting foils and blades of the forming section to maximise formation benefits.

We have found that relatively smaller diameter, high elastic modulus yarns can be used in place of conventional, relatively larger diameter polyethylene terephthalate(PET) yarns as the warp yarns in the fabrics of this invention, to provide equivalent mechanical strength properties. It is thus possible to use these smaller diameter yarns to provide the fabric with a relatively high paper side layer drainage area at a lower warp yarn density in the paper side surface. This in turn allows for the use of a higher number of cross machine direction weft yarns than would otherwise be possible in the paper side surface so as to increase fiber support in the sheet, thereby improving formation. These extra weft yarns will in turn contribute to overall fabric stiffness and stability which are necessary for dependable service life (i.e. "runnability")

The fabrics of this invention are thus able both to drain fluid from the sheet more rapidly than would be possible in comparable fabrics woven using larger warp yarns, and to provide increased support for the papermaking fibers in the stock so as to improve overall formation. Use of these high elastic modulus yarns also improves the resistance of the fabrics to damage from high pressure showers such as are used to clean them during use. Further, these smaller diameter, high elastic modulus warp yarns will be recessed to an extent into the machine side surface of the fabric due to both machine side layer weave design and the heatsetting conditions used to process the fabric following weaving. Following heatsetting, the weft yarns on the machine side of the fabric tend to bow, or crimp outwardly, forming a wear plane which serves to protect the warp yarns from abrasion during use. This feature serves to increase further the service life of these fabrics.

SUMMARY OF THE INVENTION

In a first broad embodiment the present invention seeks to provide a composite forming fabric having a paper side layer and a machine side layer, which comprises:

(i) a first set of paper side layer weft yarns, (ii) a second set of machine side layer weft yarns which are larger than the paper side layer weft yarns, and (iii) a set of triplet warp yarns which contribute to the structure of both the paper side layer and the machine side layer, which three sets of yarns are woven together according to a repeating pattern wherein:

(a) each member of each triplet set of warp yarns interweaves with the paper side layer weft yarns to occupy in sequence segments of a single unbroken warp path in the paper side layer;

(b) the sequence of segments repeats as part of the repeating pattern;

(c) each segment in the unbroken warp path is separated next segment by at least one paper side layer weft yarn;

(d) each member of each triplet interlaces separately with a single machine side layer weft yarn at least once within the pattern repeat;

(e) within the fabric repeating pattern the number of machine side layer weft yarns between each interlacing point of successive yarns from each triplet of warp yarns is constant; and (f) within the fabric repeating pattern the path lengths of each member of each triplet set is the same.

In a preferred embodiment of this invention, the fabric as woven and prior to heat setting has a warp fill of from 100% to 125%.

In the forming fabrics of this invention, thermoplastic monofilaments are used for both the warp yarns and the weft yarns.

In a first embodiment, the first and second set of weft yarns and the warp yarns are all monofilaments of the same thermoplastic. Preferably, the warp yarns and the first and second sets of weft yarns are all polyethylene terephthalate monofilaments.

In a second embodiment, the first set of weft yarns, the second set of weft yarns and the warp yarns are not all monofilaments of the same thermoplastic.

In a third embodiment, the first set of weft yarns comprises at least a first and a second subset of weft yarns and each subset comprises monofilaments of different thermoplastics.

In a fourth embodiment, the second set of weft yarns comprises at least a third and a fourth subset of weft yarns and each subset comprises monofilaments of different thermoplastics.

In a fifth embodiment, the warp yarns are thermoplastic monofilaments having a higher modulus of elasticity than the paper side layer weft yarn thermoplastic monofilaments. Preferably the ratio of the moduli of elasticity of the warp yarns and the paper side layer weft yarns is about 4:3.

Preferably, within each of the first set of weft yarns, the second set of weft yarns, and the warp yarns, the yarns are all of the same size.

Preferably, the first set and the second set of weft yarns are polyethylene terephthalate monofilaments.

Preferably, the second set of weft yarns are yarns chosen from the group consisting of polyethylene terephthalate monofilaments, monofilaments of a blend of polyethylene terephthalate and a thermoplastic polyurethane; polyamide monofilaments and mixtures thereof. More preferably, in the second set of weft yarns the third subset comprises monofilaments of a blend of polyethylene terephthalate and a thermoplastic polyurethane, the fourth subset are yarns chosen from the group consisting of polyethylene terephthalate monofilaments, polyamide monofilaments and mixtures thereof, and the third subset comprises at least 50% of the yarns in the second set in the machine side layer.

Preferably, the warp yarns are chosen from the group consisting of polyethylene terephthalate monofilaments, polyethylene naphthalate monofilaments, and mixtures thereof.

Preferably, the warp yarns are chosen from the group consisting of polyethylene naphthalate monofilaments, polyethylene terephthalate monofilaments and mixtures of polyethylene naphthalate monofilaments and polyethylene terephthalate monofilaments.

Preferably, the polyamide monofilaments are polyamide-6 or polyamide-6/6 monofilaments.

In further preferred embodiments of this invention, the fabric after heat setting has a paper side layer having an open area, when measured by a standard test procedure, of at least 35%, the fabric has a warp fill of from 100% to 110%, and the fabric has an air permeability, when measured by a standard test procedure, of from less than about 10,500 $m^3/m^2/hr$, to as low as about 3,500 $m^3/m^2/hr$ at a pressure differential of 127 Pa through the fabric. An appropriate test procedure for determining fabric air permeability is ASTM D 737-96. Paper side layer open area is determined by the method described in CPPA Data Sheet G-18 using a plan view of this layer of the fabric.

It is a requirement of this invention that every warp yarn comprises a triplet of warp yarns; each member of each triplet in turn occupies a portion of an unbroken warp path in the paper side surface weave pattern which repeats within the fabric weave pattern. Within the forming fabric overall weave pattern, each member of each of the triplet warp yarns passes alone into the machine side layer to interlace with at least one machine side layer weft, so as to form a single coherent fabric. The interlacing locations are knuckles formed by the interlacing of the separate members of each of the triplets with machine side layer weft yarns, so that within the fabric weave pattern repeat all three members of each triplet interlace at least once with a machine side layer weft. The number of interlacing points within the weave pattern repeat is determined by the shed combination required for the individual weave patterns chosen for the paper side layer and the machine side layer. The location of interlacing points is chosen so that they are regularly spaced within the machine side layer, with the same number of machine side layer weft yarns between each interlacing point.

In the preferred embodiments of this invention the warp monofilament yarns and machine side layer weft monofilament yarns are fabricated from different thermoplastics. For example, polyethylene terephthalate, which is commonly used in weaving forming fabrics, provides monofilaments with an elastic modulus of from about 1,400 $kg/m^2$ to about 1,550 $kg/m^2$, whereas polyethylene naphthalate provides monofilaments with an elastic modulus of about 2,000 $kg/m^2$. This ratio in the moduli of about 4:3 has been found particularly advantageous.

The combinations of thermoplastic yarn materials in Table 1 have been found to be suitable.

TABLE 1

| Combination | Warp | First Weft | Second Weft |
|---|---|---|---|
| A | PET | PET | PET |
| B | PEN | PET | PET |
| C | PET | PET | PET/TPU |
| D | PET | PET | PET/TPU + PA6 |
| E | PET | PET | PET/TPU + PET |
| F | PEN | PET | PET/TPU |
| G | PEN | PET | PET/TPU + PA6 |
| H | PEN | PET | PET/TPU + PET |
| I | PEN | PET | PET + PA6 |
| J | PET | PET | PET + PA6 |

Notes to Table 1.
PET: polyethylene terephthalate.
PEN: polyethylene naphthalate.
PEN/TPU: polyethylene terephthalate modified with thermoplastic polyurethane (see Bhatt et al.)
PA6: polyamide-6.

In Table 2 when mixtures of two yarns are identified, eg for Combination D, it is preferred that the two yarns alternate.

When this combination of yarns with differing moduli of elasticity is used, it has been found that the relatively higher modulus warp yarns can be woven into the fabric structure so as to impart sufficient crimp to the machine side layer weft yarns to cause them to bow outwardly from the plane of the machine side layer. By careful selection of the heat setting conditions after weaving, the crimp imparted to the machine side layer weft yarns can be enhanced, which serves to recess the warp yarns into the structure of the fabric and thus protect them from abrasive wear. This step also allows each member of each triplet set to follow more or less the same path within the fabric weave structure, which assists in reducing variations in the paper side layer mesh, thereby reducing any tendency for the fabric to cause wire mark.

It is thus apparent that in the fabrics of this invention the weft yarns can be made to bow towards the various structures which support the forming fabric in a papermaking machine forming section. This creates a wear plane on the machine side of the forming fabric. When the machine side layer weft yarns include a relatively highly abrasion resistant monofilament, such as the polyethylene terephthalate—thermoplastic polyurethane materials described by Bhatt et al. in U.S. Pat. No. 5,169,171 and in U.S. Pat. No. 5,502,120, or a polyamide such as polyamide-6 and polyamide-6/6, the fabric will be more resistant to wear, and have a longer service life, than a comparable fabric woven without these machine side layer weft yarns.

Although the fabrics of this invention can utilise different thermoplastic monofilaments in each of the first set of wefts, the second set of wefts, and the warp, within each group of yarns all of the yarns are preferably the same size. It is also preferred that in order to obtain as uniform a paper making surface as possible, the warp yarns and the first set of weft yarns used in the paper side layer should also be substantially the same size.

In the fabrics of this invention neither the paper side layer nor the machine side layer contains any conventional warp yarns which interlace only with paper side layer weft yarns, or with machine side layer weft yarns. In the fabrics of this invention, a first group of wefts in the paper side layer, and a second group of wefts in the machine side layer, are held together within the overall weave repeating pattern by a single set of triplet warp yarns, which therefore contribute to both the structural integrity and the properties of both layers.

The length of the segments in the paper side surface unbroken warp path occupied in sequence by each member of the triplets of warp yarns, and the number of segments within one weave pattern repeat, are each open to a wide range of choices. For example, in fabrics discussed below in more detail, both use weave patterns with six segments, in which the path occupied in the weave pattern repeat by each member of the triplets is essentially the same. In the unbroken warp path in the paper side layer each segment will generally occur in sequence more than once, for example at least twice, within each complete repeat of the forming fabric weave pattern.

Preferably, each segment in the unbroken warp path in the paper side surface of the paper side layer is separated from an adjacent segment by either 1, 2 or 3 paper side layer weft yarns. Preferably, each segment in the unbroken warp path in the paper side surface of the paper side layer is separated from an adjacent segment by one paper side layer weft yarn. Alternatively, each segment in the unbroken warp path in the paper side surface of the paper side layer is separated from an adjacent segment by two paper side layer weft yarns.

Preferably, within the paper side layer weave pattern, the total segment length or lengths occupied by each member of a triplet of warp yarns occupying the unbroken warp path are identical.

Since the paths occupied by each member of a triplet of paper side layer warp yarns within the fabric weave pattern are essentially the same, and the interlacing points between the warp yarns with the machine side layer wefts are regularly spaced, the composite forming fabrics of this invention will generally be woven using a single warp beam.

Preferably, the paper side layer weave pattern is chosen from a 2×2, 3×3, 3×6 or 4×8 weave design. More preferably the paper side layer weave is chosen from a plain 2×2 weave; a 3×3 weave; and a 4×4 weave. Preferably, the weave design of the machine side layer is chosen from a 3×3, 4×4, 4×8, 5×5, 6×6 or 6×12 weave design. More preferably the weave design of the machine side layer is chosen from a 3×3 twill, a 6-shed broken twill, a 9×9 twill or an N×2N design such as is disclosed by Barrett in U.S. Pat. No. 5,544,678. Most preferably, the weave design of the machine side layer is a 9×9 twill.

Preferably, the ratio of the number of paper side layer weft yarns to machine side layer weft yarns is chosen from 1:1, 2:1, 3:2, 5:3, or 3:1. More preferably, the ratio is 2:1.

Due to the unique structure of the fabrics of this invention, it is not possible to define a ratio of paper side layer warp yarns to machine side layer warp yarns. Only one member of a triplet appears at a time in the paper side layer, and only one member of a triplet set appears at a time in the machine side layer. The fabric thus appears to have a 1:1 warp ratio, but this is not meaningful in the context of these fabrics.

In the fabrics of this invention, selection of the paper side layer design and the machine side layer design must meet two criteria: first, in each repeat of the paper side layer weave design, each member of each triplet set of warp yarns interweaves in the paper side layer to occupy in sequence the segments of the unbroken warp path, and second in the machine side layer each member of each triplet interlaces alone at least once with a weft yarn in each repeat. This can be achieved by ensuring that quotients which can be expressed as Q/P and Q/M, in which Q is the total number of sheds, P is the number of sheds required to weave the paper side layer design, and M is the number of sheds required to weave the machine side layer design. Q, M and P are always integers. For example, if P=2 and M=9 then Q=18 so that Q/P=9 and Q/M=2.

In the simplest embodiments, the fabrics of this invention will be woven according to weave patterns requiring a loom equipped with at least six sheds. This will accommodate a plain weave pattern for both the paper side layer and the machine side layer, and will require three repetitions of the pattern to accommodate each of the three members of the triplets. However, such a simple embodiment is not generally preferred, as machine side layer wear resistance of the resulting fabric may not be adequate for most applications.

In the preferred embodiments of this invention, either a 2×2 plain weave, or a 3×3 twill weave is used for the paper side layer, combined with a 6-shed twill, a 6-shed broken twill, a 9×9 twill or an N×2N weave design for the machine side layer. The combination of a 2×2 plain weave with a 6×6 twill will require 18 sheds: the 6×6 twill will require 18, and the 2×2 plain weave will require 6, thus giving quotients of 1 and 3 respectively.

Table 2 summarizes some of the possible paper side layer and machine side layer weave pattern combinations, together with the shed requirements for each.

TABLE 2

| PSL Weave | PSL Sheds, P | MSL Weave | MSL Sheds, M | Total Sheds, Q | Quotient Q/P, Q/M |
|---|---|---|---|---|---|
| 2x2 | 6 | 6x6 | 18 | 18 | 3, 1 |
| 2x2 | 6 | 6x12 | 18 | 18 | 3, 1 |
| 2x2 | 2 | 9x9 | 9 | 18 | 9, 2 |
| 3x3 | 9 | 6x12 | 18 | 18 | 2, 1 |
| 3x6 | 9 | 6x12 | 18 | 18 | 2, 1 |
| 2x2 | 6 | 4x4 | 12 | 12 | 2, 1 |
| 2x2 | 6 | 4x8 | 12 | 12 | 2, 1 |
| 3x3 | 9 | 4x4 | 12 | 36 | 4, 3 |
| 4x8 | 12 | 4x4 | 12 | 12 | 1, 1 |
| 4x8 | 12 | 4x8 | 12 | 12 | 1, 1 |
| 4x8 | 12 | 4x8 | 12 | 12 | 1, 1 |
| 2x2 | 6 | 5x5 | 15 | 30 | 5, 2 |
| 3x3 | 9 | 5x5 | 15 | 45 | 5, 3 |

In the headings to Table 2, "PSL" indicates paper side layer number of sheds P, "MSL" indicates machine side layer number of sheds M, "Total Sheds" indicates the minimum number of sheds Q required to weave the fabric, and Q/P, Q/M are the integer values of the quotients of the number of the sheds required for the paper side layer divided into the total sheds, and the number of sheds required for the machine side layer divided into the total sheds respectively.

Because all of the triplets of warp yarns making up the paper side layer warp yarns are utilized to interlace with machine side layer weft yarns, this interlacing pattern improves fabric modulus, thus making the fabric more resistant to stretching and distortion, while reducing lateral contraction and any propensity for fabric layer delamination.

An important distinction between prior art fabrics and those of the present invention is the total warp fill, which is given by warp fill=(warp diameter×mesh×100) %. Warp fill can be determined either before or after heat setting, and, for the same fabric, is generally somewhat higher after heat setting. In all prior art composite fabrics, prior to heat setting, the sum of the warp fill in the paper side and machine side layers combined is typically less than 95%. The fabrics of this invention prior to heat setting can have a total warp fill that preferably is about 100%. After heat setting, the fabrics of this invention have a total warp fill that can be greater than 105%, and is typically about 110% or more.

In the context of this invention certain definitions are important.

The term "unbroken warp path" refers to the path in the paper side layer, which is visible on the paper side surface of the fabric, of the triplets of warp yarns, and which is occupied in turn by each member of the triplets making up the warp yarns. This path continues along the fabric as the fabric weave pattern repeats.

The term "segment" refers to the portion of the unbroken warp path in the paper side layer repeating pattern occupied by a specific warp yarn, and the associated term "segment length" refers to the length of a particular segment, and is expressed as the number of paper side layer weft yarns with which a member of a triplet of warp yarns interweaves within the segment.

The term "float" refers to a yarn which passes over a group of other yarns without interweaving with them; the associated term "float length" refers to the length of a float, expressed as a number indicating the number of yarns passed over.

The term "internal float" has a similar meaning and refers to that portion of a yarn which passes between the layers of a composite fabric for a short distance following interweaving with the paper side layer or interlacing with the machine side layer. The associated term "internal float length" refers to the number of yarns from either the paper side layer or the machine side layer, as appropriate, between the two ends of an internal float.

The term "interlace" refers to a point at which a single member of a triplet of warp yarns wraps alone about a machine side weft to form a single knuckle, and the associated term "interweave" refers to a locus at which a single member of a triplet wraps about one or more paper side layer weft yarns and forms either a knuckle or a float with at least one paper side weft.

BRIEF DESCRIPTION OF THE DRAWINGS

The invention will now be described by way of reference to the drawings, in which.

Figure 1:
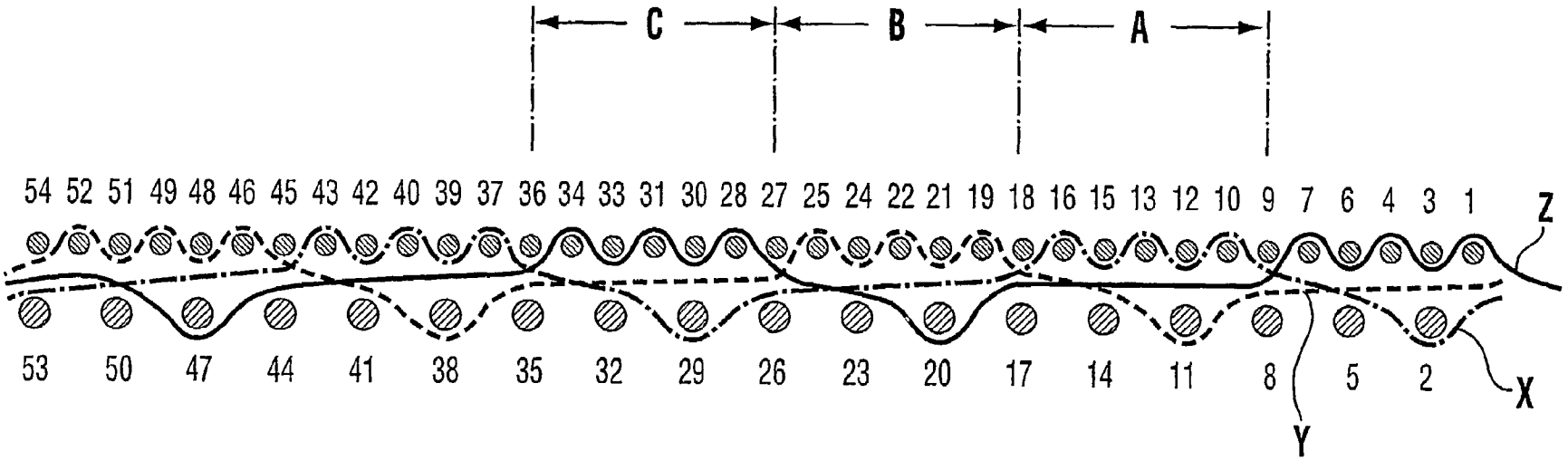
FIG. 1 is a cross sectional view of a first embodiment of a forming fabric according to the invention showing the paths of one triplet of warp yarns in one repeat of the forming fabric weave pattern.
Figure 2:
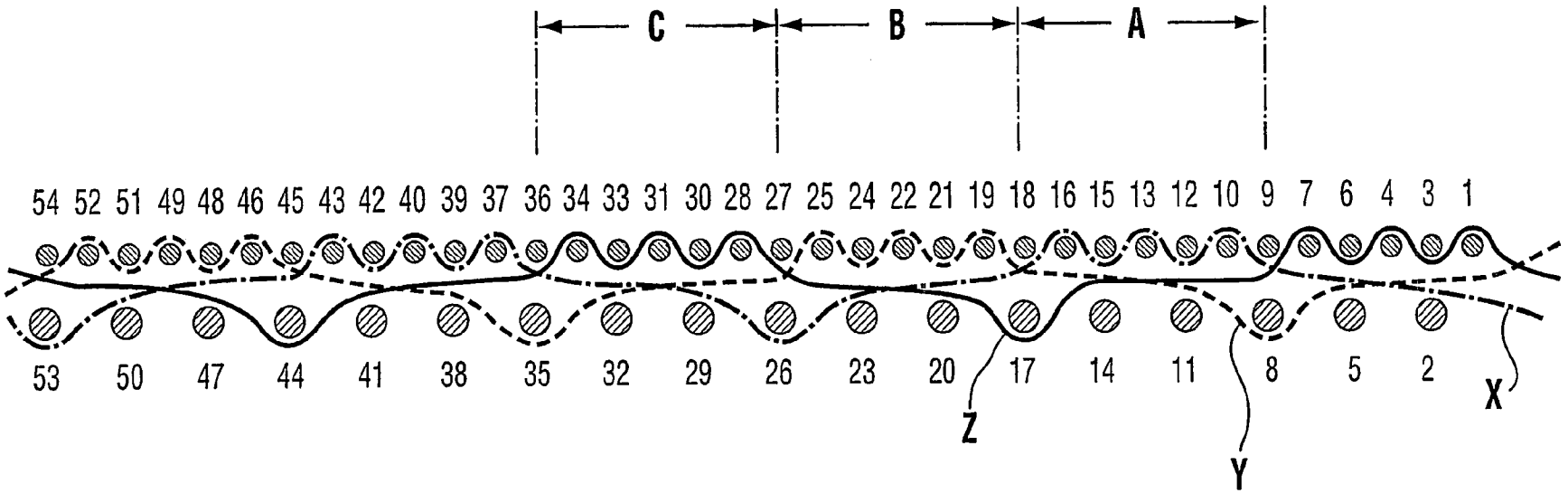
FIG. 2 shows a cross sectional view similar to FIG. 1 of a second embodiment.

In each of the schematic cross sectional views of FIGS. 1 and 2, within the pattern repeat the cut weft yarns shown are numbered from 1, starting with the first paper side layer weft at one side, and finishing with the last paper side layer weft at the other. The arrows A, B and C indicate length of the paper side layer segments in FIGS. 1 and 2. Also, in FIGS. 1 and 2 the three members shown of one triplet warp set are labelled X, Y and Z. In both of the composite forming fabrics shown in FIGS. 1 and 2 the same weave pattern continues in each direction away from the cross section shown along the length of the fabric. The weave pattern also continues across the width of the fabric, but will be moved laterally so that the interlacing locations with the machine side layer wefts are not always with the same weft.

DETAILED DESCRIPTION OF THE FIGURES

FIG. 1 is a cross sectional illustration of a first embodiment of a forming fabric according to the present invention, taken along the line of one of the warp yarn triplets. In FIG. 1 the paper side layer of the fabric is a 2×2 plain weave, and the machine side layer is a 3×3 weave; this follows because although three warp yarns are shown in FIG. 1, each triplet set comprising the three yarns shown functions as a single warp.

The unbroken warp path within the paper side layer includes the following three segments:

- triplet Z interweaves with wefts 1; 3, 4, 6, 7 and 9, by passing under wefts 3, 6 and 9 and passing over the others;
- triplet X interweaves with wefts 10, 12, 13, 15, 16 and 18, by passing under wefts 12, 15 and 18 and passing over the others; and
- triplet Y interweaves with wefts 19, 21, 22, 24, 25 and 27, by passing under wefts 21, 24 and 27 and passing over the others.

Within these three segments there are three machine side layer interlacing points:

- triplet Z interlaces with weft 20;
- triplet X interlaces with weft 2; and
- triplet Y interlaces with weft 11.

These three segments with their accompanying interlacing points then repeat with wefts 28 through 54.

The fabric of FIG. 1 is woven in 18 sheds; it could also be woven in 36.

It is thus apparent that all three members X, Y and Z of the triplet occupy in sequence segments of the unbroken warp path in the paper side layer which are separated by one paper side layer weft, and all three members interlace alone with three regularly spaced machine side layer wefts within the length of the three paper side layer warp path segments.

This relatively simple weave also shows several other features of this invention. Inspection of the paper side layer shows that the triplets X, Y and Z follow the same path, with each one shifted along the pattern relative to the others. It can also be seen that although the spacing of the interlacing points is constant with two machine side layer wefts between each of them, the internal float lengths for each of X, Y and Z each side of the interlacing point are not the same.

Inspection of segment A shows that triplet Z leaves the paper side layer between wefts 7 and 9, forms an internal float over machine side layer wefts 11, 14 and 17. In segment B, triplet Z interlaces with machine side layer 20, and forms and internal float over machine side layer wefts 23 and 26. In segment C, triplet Z re-enters the paper side layer between paper side layer wefts 27 and 28, interweaves with paper side layer wefts 28, 30, 31, 33 and 34 and Z then leaves the paper side layer between wefts 34 and 36. The same pattern is followed as triplet Z interlaces with machine side weft 47. There is thus an unequal internal float length in triplet Z either side of wefts 20 and 47. This applies equally to triplet X as it interlaces with wefts 2 and 29, and to triplet Y as it interlaces with wefts 11 and 38. Although the difference in internal float lengths is small, as is shown in FIG. 2 it can be avoided and yet still retain regular spacing for the interlacing points.

In FIG. 2, the paper side layer again is a 2×2 weave, with one weft between succeeding segments, and the machine side layer is woven to the same 3×3 design.

The three warps X, Y and Z follow essentially the same path in the paper side layer is as is described for FIG. 1. In sequence in segment A triplet X enters the paper side layer between paper side layer wefts 9 and 10, interweaves with wefts 10, 12, 13, 15 and 16 and leaves the paper side layer between paper side layer wefts 16 and 18. Triplet Y follows the same path between paper side layer wefts 18 and 27, and triplet Z follows the same path between paper side layer wefts 27 and 36.

In the machine side layer although the interlacing points are regularly spaced with two machine side layer wefts between each of them, the interlacing points are differently located relative to the paper side layer so that the triplet internal float lengths are essentially the same each side of the interlacing point. The path of triplet Z shows the difference.

In segment A, triplet Z leaves the paper side layer between paper side layer wefts 7 and 9, forms an internal float over machine side layer wefts 8, 11 and 14, interlaces with machine side layer weft 17. In segment B, triplet Z forms an internal float over machine side layer wefts 22, 23 and 26, and re-enters the paper side layer between paper side layer wefts 27 and 28. It cab thus be seen that the internal floats in the path of triplet Z are the same length each side of its interlacing points with machine side wefts 17 and 44. The other two triplets follow the same path, with equal float lengths either side of wefts 8 and 35 for triplet Y, and either side of wefts 26 and 53 for triplet X.

This re-location of the interlacing points provides a forming fabric with more uniform location of the drainage openings, and a more uniform size for the drainage openings.

Inspection of the machine side layers of FIGS. 1 and 2 shows that the interlacing points of each of the triplets X, Y and Z can be recessed to an extent from the wear plane of the machine side layer of the fabric by the machine side layer weft floats exposed on the machine side of the fabric, thus potentially increasing fabric life. As the exposed weft float length in the machine side layer weave pattern becomes shorter, the interlacing points are recessed to a lesser degree. Wear at these locations can thus be minimised by choosing a machine side layer weave pattern that will provide long exposed weft float lengths between the interlacing points. It is also apparent from these diagrams that although the three members of each triplet occupy in sequence the segments of the unbroken warp path in the paper side surface, the weave pattern does not include any gaps since the pattern continues along the fabric without any breaks in either the longitudinal or transverse directions.

It is also possible to improve the protection provided for the interlacing points by a careful choice of the yarn materials used for the warps and wefts respectively and of the conditions under which the fabric is heat set. The yarn materials can be chosen so that the warp triplets are relatively stiffer than the machine side layer wefts, so that the machine side layer wefts have to crimp more than the warp triplets at the interlacing points. The heat setting conditions can be chosen to achieve two objects:

(a) the stiffer warps are placed under sufficient tension to hold them relatively straight; and (b) the temperature is selected to promote crimping of the wefts relative to the warps.

Typical yarn combinations and the required heat setting conditions are in Table 3.

TABLE 3

| Warp | Machine Side Layer Weft | Heat Set Temperature | Heat Set Tension |
|---|---|---|---|
| PET | PET/TPU | about 190° C. | about 805 kg/m |
| PEN | PET/TPU | about 190° C. | about 805 kg/m |

The abbreviations for the thermoplastics yarn thermoplastic materials are those used in Table 1.

A further benefit provided by the use of relatively high elastic modulus warp yarns is that it is possible to diminish the size of the warp yarn. At the same yarn count, this provides a fabric with a lower warp fill and higher air permeability.

As has been previously discussed, the weave structure of the paper side layer must "fit" onto the weave structure of the machine side layer. There are at least three reasons for this.

First, the locations at which each triplet of warp yarns interlaces with a machine side layer weft yarn must coincide with the interweaving location with the paper side layer of one of the other triplets. The weave structures of each layer must therefore be such that this may occur without causing any undue deformation of the paper side layer paper side surface.

Second, the paper side layer and machine side layer weave structures should fit such that the locations at which each triplet interlaces with a machine side layer weft is as far removed as possible from the ends of the segments in the paper side layer weave pattern occupied by the another member of the triplet. This will reduce dimpling and any other surface imperfections caused by bringing the interlacing triplet down from the paper side layer into the machine side layer.

Third, the locations at which each triplet interlaces with a machine side layer weft yarn should be recessed into the machine side layer as much as possible from the wear plane of the machine side layer, so as to extend the fabric service life. This may be accomplished by making the exposed machine side layer float between two successive interlacing points as long as possible. The length of a machine side layer weft float will increase with the number of sheds used to weave the machine side layer pattern. Thus it is generally preferred that the machine side layer of the fabrics of this invention be woven according to patterns requiring at least 4 sheds, and preferably at least 6.

Experimental Trials

Four sample fabrics were woven as follows:

Sample fabric A was woven to the design in FIG. 1; and

Sample fabrics B, c and D were woven to the design in FIG. 2.

The details of these four fabric Samples are shown in Table 4.

TABLE 4

| Fabric Property | Sample A | Sample B | Sample C | Sample D |
|---|---|---|---|---|
| PS Mesh, As Woven | 40.2 × 18.9 | 49.6 × 19.7 | 49.6 × 20.0 | 49.6 × 26.8 |
| MS Mesh, As Woven | 40.2 × 11.0 | 49.6 × 9.8 | 49.6 × 10 | 49.6 × 13.4 |
| PS Mesh, Heatset | 45 × 17.3 | 55 × 18.5 | 53.5 × 18.1 | 56.7 × 25.2 |
| MS Mesh, Heatset | 45 × 8.7 | 55 × 9.3 | 53.5 × 9 | 56.7 × 12.6 |
| Warp Diameter | 0.25 mm | 0.20 mm | 0.20 mm | 0.20 mm |
| Warp Material | PET | PEN | PEN | PEN |
| PS Weft Diameter | 0.26 mm | 0.22 mm | 0.22 mm | 0.18 mm |
| PS Weft Material | PET | PET | PET | PET |
| MS Weft Diameter | 0.45 mm | 0.45 mm | 0.45 mm | 0.30 mm |
| MS Weft Material | PET/TPU | PET/PA-6 | PET/PA-6 | PET |
| PS Weave | Plain Weave | | | |
| MS Weave | 1/8 Float | | | |
| Heatset Temperature | Approx. 200° C. | | | |
| Cloth Elastic Modulus | 2590 kg/cm | 1744 kg/cm | 2068 kg/cm | 1846 kg/cm |
| Fabric Caliper | 0.019 mm | 0.017 mm | 0.0165 mm | 0.0146 mm |
| MS Weft Crimp | −0.0059 | 0 | 0 | −0.0044 |
| Warp Fill as woven | 100% | 100% | 100% | 100% |
| Warp Fill, Heatset | 110% | 110% | 110% | 110% |
| Fiber Support Index (Beran) | 84 | | | |
| Air Permeability | 7,890 | 10,300 | 8,210 | 8,690 |

Notes to Table 4.
PS: paper side layer.
MS: machine side layer.
Mesh: warp × weft per cm.
PET, PEN, PA6 and PET/TPU: see Table 1.
PET/PA-6: Alternating yarns of PET and PA-6.

TABLE 4-continued

| Fabric Property | Sample A | Sample B | Sample C | Sample D |
|---|---|---|---|---|

Air Permeability: $m^3/m^2$/hour; measured on the heat set fabric by ASTM D 737-96 using high pressure machine as available from Frazier High Precision Instrument Co., Gaitherburg, MA, USA, at a pressure differential of 127 Pa through the fabric.
Elastic Modulus of Cloth: slope of a stress-strain curve at a tension of from 3.6 kg/cm to 7.1 kg/cm in a CRE type tensile testing machine.
Caliper: average of at least 5 thickness measurements.
MS Weft Crimp: the amount by which the knuckles of the machine side layer weft yarns lie above (negative value) or below (positive value) the plane of the machine side layer warps.
Warp Fill: (warp diameter × mesh × 100)%,
Fiber Support Index: determined according to the relationship provided in CPPA Date Sheet G-18 and refers to amount of support provided by the paper side surface of the paper side layer available to support the papermaking fibers in the stock deposited thereon.

Inspection of Table 4 shows that although the elastic modulus of Sample A was significantly higher, this fabric also has the highest caliper, due at least in part to the yarn materials used in it. The fabrics of Samples A and D both show a negative MS weft crimp, which indicates that in these fabrics a good wear life can be expected due to the outward bowing of the long floats in the machine side layer weave design. This wear life is also enhanced by the use of the PET/TPU material in the machine side layer weft yarns.

Selection of appropriate warp and weft yarn diameters for use in the fabrics of this invention will depend on many factors, including the grade of paper product which the fabric will be used to produce and will affect the air permeability of the resulting fabric. Selection of appropriate yarn diameters will be made in accordance with the intended end use of the fabric.

Table 4 shows that the fabrics of this invention possess good air permeability, of from 10,300 down to 7,890 $m^3/m^2/hr$ in the sample fabrics for which data is given in Table 4. Fabric air permeability may be further reduced by appropriate choice of paper side and/or machine side yarn diameter and mesh. By reducing fabric air permeability, fluid drains more slowly through both the paper and machine side fabric layers, which result in improved formation and reduced wire mark. Laboratory analysis of hand sheets produced on the fabric samples described in Table 4 confirms that wire mark is reduced compared to other prior art fabrics, and that the sheets offer improved printability characteristics.

What is claimed is:

1. A composite forming fabric having a paper side layer and a machine side layer, which comprises:

(i) a first set of paper side layer weft yarns, (ii) a second set of machine side layer weft yarns which are larger than the paper side layer weft yarns, and (iii) a set of triplet warp yarns which contribute to the structure of both the paper side layer and the machine side layer, which three sets of yarns are woven together according to a repeating pattern wherein:

(a) each member of each triplet set of warp yarns interweaves with the paper side layer weft yarns to occupy in sequence segments of a single unbroken warp path in the paper side layer;

(b) the sequence of segments repeats as part of the repeating pattern;

(c) each segment in the unbroken warp path is separated next segment by at least one paper side layer weft yarn;

(d) each member of each triplet interlaces separately with a single machine side layer weft yarn at least once within the pattern repeat;

(e) within the fabric repeating pattern the number of machine side layer weft yarns between each interlacing point of successive yarns from each triplet of warp yarns is constant; and (f) within the fabric repeating pattern the path lengths of each member of each triplet set is the same.

2. A forming fabric according to claim 1 wherein the fabric as woven and prior to heat setting has a warp fill of from 100% to 125%.

3. A fabric according to claim 1 wherein the warp and weft yarns are thermoplastic monofilaments.

4. A fabric according to claim 3 wherein the first and second set of weft yarns and the warp yarns are all monofilaments of the same thermoplastic.

5. A fabric according to claim 4 wherein the warp yarns and the first and second sets of weft yarns are all polyethylene terephthalate monofilaments.

6. A fabric according to claim 3 wherein the first set of weft yarns, the second set of weft yarns and the warp yarns is are not all monofilaments of the same thermoplastic.

7. A fabric according to claim 3 wherein the first set of weft yarns comprises at least a first and a second subset of weft yarns and each subset comprises monofilaments of different thermoplastics.

8. A fabric according to claim 3 wherein the second set of weft yarns comprises at least a third and a fourth subset of weft yarns and each subset comprises monofilaments of different thermoplastics.

9. A fabric according to claim 1 wherein the warp yarns are thermoplastic monofilaments having a higher modulus of elasticity than the machine side layer weft yarn thermoplastic monofilaments.

10. A fabric according to claim 9 wherein the ratio of the moduli of elasticity of the warp yarns and the machine side layer weft yarns is about 4:3.

11. A fabric according to claim 1 wherein within each of the first set of weft yarns, the second set of weft yarns, and the warp yarns, the yarns are all of the same size.

12. A fabric according to claim 3 where in the first set and the second set of weft yarns are polyethylene terephthalate monofilaments.

13. A fabric according to claim 1 wherein the second set of weft yarns are yarns chosen from the group consisting of polyethylene terephthalate monofilaments, monofilaments of a blend of polyethylene terephthalate and a thermoplastic polyurethane; polyamide monofilaments and mixtures thereof.

14. A fabric according to claim 13 wherein in the second set of weft yarns the third subset comprises monofilaments of a blend of polyethylene terephthalate and a thermoplastic polyurethane, the fourth subset are yarns chosen from the group consisting of polyethylene terephthalate monofilaments, polyamide monofilaments and mixtures thereof, and the third subset comprises at least 50% of the yarns in the second set in the machine side layer.

15. A fabric according to claim 3 wherein the warp yarns are chosen from the group consisting of polyethylene terephthalate monofilaments, polyethylene naphthalate monofilaments, and mixtures thereof.

16. A fabric according to claim 13 or 14 wherein the polyamide monofilaments are chosen from the group consisting of polyamide-6 and polyamide-6/6 monofilaments.

17. A forming fabric according to claim 1 wherein the fabric has an air permeability, when measured by a standard test procedure, of from less than about 7,500 $m^3/m^2/hr$, to about 11,000 $m^3/m^2/hr$ at a pressure differential of 127 Pa through the fabric.

18. A forming fabric according to claim 1 wherein the paper side layer weave design is chosen from the group consisting of a 2×2, 3×3, 3×6 or 4×8 weave design.

19. A fabric according to claim 18 wherein the paper side layer weave design is chosen from the group consisting of a plain 2×2 weave, a 3×3 weave, and a 4×4 weave.

20. A fabric according to claim 1 wherein the machine side layer weave design is chosen from the group consisting of a 3×3, 4×4, 4×8, 5×5, 6×6 or 6×12 weave design.

21. A fabric according to claim 20 wherein the weave design of the machine side layer is chosen from a 3×3 twill, a 6-shed broken twill, or an N×2N design as disclosed by Barrett in U.S. Pat. No. 5,544,678.

22. A fabric according to claim 1 wherein the ratio of paper side layer weft yarns to machine side layer weft yarns is chosen from 1:1, 2:1, 3;2, 5;3 and 3:1.

23. A fabric according to claim 22 wherein the ratio of paper sidle layer weft yarns to machine side layer weft yarns is about 2:1.

24. A fabric according to claim 1 wherein the quotients expressed as Q/P and Q/M, in which Q is the total number of sheds, P is the number of sheds required to weave the paper side layer design, and M is the number of sheds required to weave the machine side layer design are integers.

25. A fabric according to claim 3 wherein the warp yarns are polyethylene naphthalate, the first set of weft yarns are polyethylene terephthalate, and in the second set of weft yarns the third subset comprises monofilaments of a blend of plyethylene terephthalate and a thermoplastic polyurethane and the fourth subset comprises polyamide monofilaments.

26. A fabric according to claim 3 wherein the warp yarns are polyethylene terephthalate, the first set of weft yarns are polyethylene terephthalate, and in the second set of weft yarns the third subset comprises monofilaments of a blend of plyethylene terephthalate and a thermoplastic polyurethane and the fourth subset comprises polyamide monofilaments.

* * * * *

UNITED STATES PATENT AND TRADEMARK OFFICE

CERTIFICATE OF CORRECTION

PATENT NO. : 7,108,020 B2
APPLICATION NO. : 10/490601
DATED : September 19, 2006
INVENTOR(S) : Richard Stone It is certified that error appears in the above-identified patent and that said Letters Patent is hereby corrected as shown below:

On the Title page of the patent, the priority claim was omitted, and should read:

Item (30) Foreign Application Priority Data
Aug. 6, 2002 (GB)..... 0218245,9

Signed and Sealed this

Twenty-fourth Day of April, 2007

JON W. DUDAS
*Director of the United States Patent and Trademark Office*